US005865541A

United States Patent [19]

Lafleur

[11] Patent Number: 5,865,541

[45] Date of Patent: Feb. 2, 1999

[54] BULK CONTAINER LINER AND METHOD

[75] Inventor: Lee Lafleur, Manistee, Mich.

[73] Assignee: Custom Packaging Systems, Inc., Manistee, Mich.

[21] Appl. No.: 798,709

[22] Filed: Feb. 12, 1997

[51] Int. Cl.[6] ..... B65D 30/20

[52] U.S. Cl. ..... 383/120; 383/105; 383/122

[58] Field of Search ..... 383/120, 107, 383/108, 105, 122

[56] References Cited

U.S. PATENT DOCUMENTS

| | | | |
|---|---|---|---|
| 3,319,684 | 5/1967 | Calhoun | 383/120 |
| 3,349,991 | 10/1967 | Kessler | 383/120 |
| 3,367,380 | 2/1968 | Dickey | 383/120 |
| 3,550,662 | 12/1970 | Remkke et al. | 383/107 |
| 4,524,459 | 6/1985 | Titchenal | 383/122 |
| 4,596,040 | 6/1986 | Lafleur et al. . | |
| 4,730,942 | 3/1988 | Fulcher | 383/107 |
| 4,790,029 | 12/1988 | LaFleur et al. . | |
| 5,104,236 | 4/1992 | Lafleur . | |

*Primary Examiner*—Stephen P. Garbe
*Attorney, Agent, or Firm*—Barnes, Kisselle, Raisch, Choate, Whittemore & Hulbert, P.C.

[57] ABSTRACT

A collapsible liner for a bulk container made of a flexible material and having seamless top and bottom walls is provided. The liners are formed from a tubular blank folded to form two gusset panels received inwardly of two overlying flat panels. The blank is severed to form triangular portions adjacent opposed ends of the blank and adjacent sides of adjacent triangular portions are connected together to form a pair of generally opposed and generally rectilinear side walls of the liner. The seamless top and bottom walls are stronger than those portions of the liner with seams and are less likely to rupture or leak.

12 Claims, 2 Drawing Sheets

BULK CONTAINER LINER AND METHOD

FIELD OF THE INVENTION

This invention relates to shipping and storage containers and more particularly to a liner of a flexible material for a bulk container and a method of making the liner.

BACKGROUND OF THE INVENTION

Previously, many granular products and some liquids have been shipped and stored in large bulk bags which may contain as much as a ton or more of material. Some of these bulk bags are flexible and when empty can be folded to a generally flat condition. One such flexible bag is disclosed and claimed in U.S. Pat. No. 5,104,236.

These flexible bags have generally rectangular ends interconnected by generally rectangular side walls and, when filled, can be stacked one on top of another. For some applications the bags are made of a woven fabric and for other applications a plastic material. For some applications, and particularly for storing liquids or hazardous materials, a bag of a water impervious plastic material is received in and reinforced and protected by a bag of a woven fabric. Usually, these bags have a spout in one or both ends for filling and emptying the bags. Further, for some applications, it is desirable to have a bag of a water impervious plastic material encasing a bag of woven fabric to protect the contents of the inner bag and to contain the contents of the inner bag that leak through the inner bag.

Typically these bags are produced by severing a tubular blank to form triangular portions adjacent opposite ends of the blank. Adjacent sides of adjacent triangular portions are then connected together such as by stitching or heat sealing the edges together to form generally square and spaced apart top and bottom walls of the bag. The connections between adjacent triangular portions of the top and bottom walls of the bags are typically weaker than seamless portions of the bag and are hence subject to rupturing or tearing especially during moving or shipping of filled bags. Further, especially when liquids are being carried by the bulk bag, high stresses can result in the top and bottom of the bags, both when the bags are being lifted such as for loading onto a vehicle for shipping, and also during shipping due to the shifting of the liquid within the bag during shipping.

Thus, current bags have the weakest portion of the bag, where the triangular portions are connected together, in the top and bottom walls of the bag which can experience the highest stresses during use of the bag. Therefore, the bags are subject to rupturing adjacent their top and bottom walls which limits the load bearing capacity of the bags.

SUMMARY OF THE INVENTION

A liner for a bulk container is provided having seamless top and bottom walls, reducing the possibility of leakage through the liner. The liners preferably have generally rectangular end walls interconnected by four generally rectangular side walls which are all part of the same blank of flexible material and when empty can be folded into a flat and compact arrangement. Preferably, the blank is formed into a tubular configuration either by cutting a section from an elongate sheet of a flexible material and then connecting together side edges of the section to provide a tubular blank or, more preferably, the blank is cut from a tubular web of material which is seamless.

The tubular blank is severed adjacent opposed ends of the blank providing triangular portions adjacent those ends of the blank. Preferably, the blanks are severed according to the method disclosed in U.S. Pat. No. 4,596,040 or as disclosed in U.S. Pat. No. 4,790,029. Adjacent sides of adjacent triangular portions are then connected to form a pair generally opposed, spaced apart side walls of the liner.

When the tubular blank is formed by connecting opposing side edges of a generally rectangular piece of material, the tubular blank is oriented such that the seam where the edges are connected is not within the top or bottom walls of the liner. Thus, the top and bottom walls of the liner are seamless and are therefore relatively strong and resistant to rupturing or tearing.

Objects, features and advantages of this invention are to provide a liner for a bulk container having seamless top and bottom walls to maximize the strength of the liner, which reduces the likelihood of rupturing of the liner by disposing any seams or lines of connection in the side walls of the liner, is readily and easily adapted to the mass production of liners and is of relatively simple, economical and reliable manufacture.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENT

Figure 1:
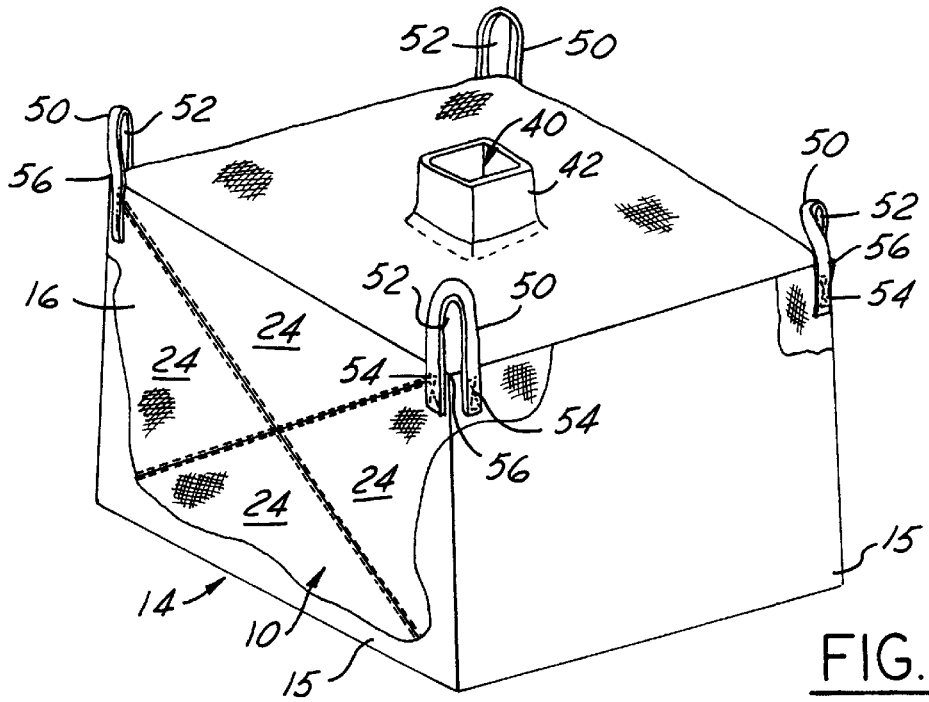
FIG. 1 is a perspective view of a bulk container with an interior liner embodying this invention.

Referring in more detail to the drawings, FIG. 1 shows a liner 10, made of a flexible material, having seamless top 12 and bottom 14 walls according to the present invention and received in a container box 15 with rigid side walls and a bottom. Alternatively, the liner 10 may also be disposed interiorly of a container bag 15. The liner 10 is formed of a material impervious to water and to the contents of the container 15 to prevent leakage and to prevent contaminants from entering the contents of the liner. For example, the liner 10 may be made from a plastic film such as polyethylene or polypropylene plastic film with a thickness in the range of about 4 to 10 mil. per layer.

The liner 10 is preferably formed in the same general configuration as the bulk container 15 and has a generally cubicle configuration with generally rectangular top 12 and bottom 14 walls interconnected by four generally rectangular side walls 16. Preferably, the liner 10 is severed from a tubular blank 18 of material that is substantially circumferentially continuous.

The blank 18 has a tubular or circumferentially continuous central portion 22 and four triangular portions 24 which are integral with the central portion 22. The triangular portions 24 form generally opposed and generally rectangular side walls 16 of the liner 10 and the central portion 22 forms the top 12 and bottom 14 walls of the liner 10 as well as a second pair of generally opposed, generally rectangular side walls 16.

Preferably, a plurality of blanks 18 are cut from an elongate tubular web 20 which is circumferentially continuous. Also preferably, the tubular web is seamless although it can be formed by connecting or joining together the side edges of an elongate sheet of flexible material, such as by heat sealing a plastic film.

Figure 2:
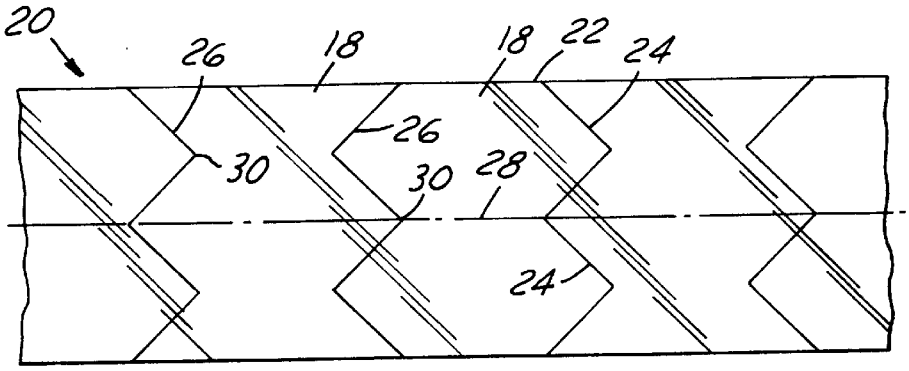
FIG. 2 is a plan view of a portion of an elongate web after being severed to form triangular portions adjacent opposed ends of adjacent blanks.

As shown in FIG. 2, a plurality of blanks 18 may be formed from the elongate web 20, without any scrap or wasting any material between them, by cutting or severing the web 20 along the zig zag lines 26 which extend through the tubular web 20. To form a pair of generally square walls, four substantially identical isosceles triangular portions 24 are formed on each end of the blank 18 with each segment of the lines 26 being of the same length and inclined at an acute included angle of substantially 45° to the longitudinal axis 28 of the web 20. Adjacent segments of each of the lines 26 form an apex 30 of a triangular portion 24 and are at substantially a right angle to each other.

Figure 3:
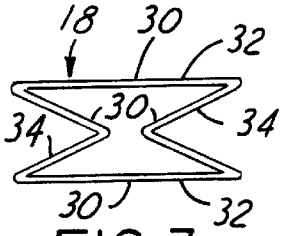
FIG. 3 is an end view of a tubular blank folded into a generally flat configuration having a pair of flat panels and a pair of folded gusset panels received therebetween.

Preferably, although not necessarily, to facilitate connecting together adjacent side edges of adjacent triangular portions 24 of each blank 18 to form a collapsible bag 10, the blanks 18 are folded into the generally collapsed configuration shown in FIG. 3. In this collapsed configuration each blank 18 has a pair of overlying and generally flat panels 32 with a pair of folded gusseted panels 34 received therebetween. To provide a pair of generally opposed side walls 16 when the liner 10 is expanded, the adjacent side edges of adjacent triangular portions 24 are connected together. The triangular portions 24 are preferably connected together by heat sealing adjacent triangular portions 24 together. More specifically if folded as shown in FIG. 3 the triangular side edges of the upper panel 30 are connected to the adjacent triangular side edges of the upper gusseted panels 34 and the triangular side edges of the lower panel 30 are connected to the adjacent triangular side edges of the lower gusseted panels 34.

To facilitate filling and emptying the liner 10, an access opening 40 is preferably provided in one or both of the top 12 and bottom 14 walls of the liner 10, or in the sidewall 16 of the liner 10 adjacent the bottom edge. The access opening 40 is preferably cut into the desired end 12, 14 or sidewall 16 of the liner 10 and provided with a spout 42 extending therefrom. Preferably, the spout 42 is a separate circumferentially continuous tube of the same material as the blank 18 of the liner 10 with one end of the spout 42 inserted into the access opening 40 and connected to the wall 12 or 14 of the liner by a series of stitches or a heat seal. This spout may also be made of rigid plastic and heat sealed onto the appropriate wall.

If desired, lifting straps 50 can be provided to hold the liner 10 in place and facilitate filling the liner 10. Preferably, each strap 50 is in the form of a loop 52 of flexible material with its legs 54 connected to the adjacent side walls 16 of the liner 10 adjacent an upper comer 56 of the liner 10. Preferably, each leg 54 of each strap 50 is connected to the liner 10 by a heat seal.

Figure 5:
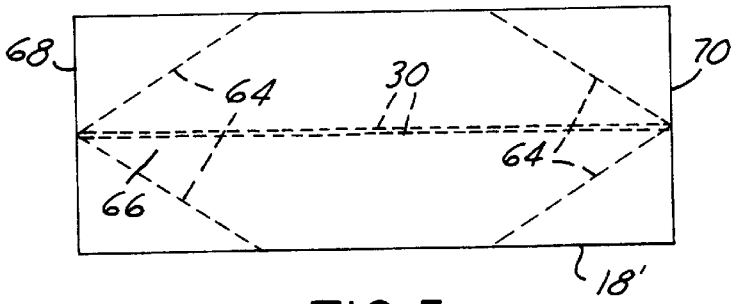
FIG. 5 is a plan view of the tubular blank of FIG. 4 gusseted severed to form a liner embodying this invention.
Figure 4:
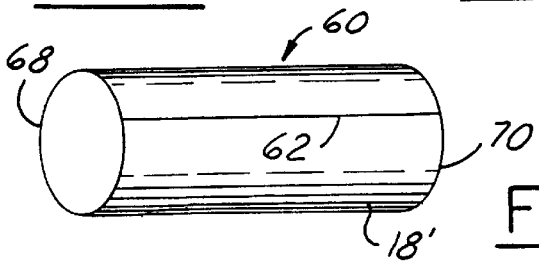
FIG. 4 is a perspective view of a tubular blank formed from a generally rectangular piece of material with its side edges connected together and forming a seam in the blank.

In an alternate embodiment as shown in FIGS. 4 & 5, the liner 10 is made from a tubular blank 18' that is formed by connecting or joining together a pair of side edges of a sheet 60 of a flexible material providing a seam 62 extending longitudinally of the tubular blank 18'. To ensure that the top 12 and bottom 14 walls of the liner 10 are seamless the blank 18' is circumferentially rotated such that the seam 62 will be disposed in the side walls 16 of the liner 10 when the liner 10 is formed from the blank 18'. Preferably, the seam is substantially centered between the top and bottom of the side walls in which it is disposed. The blank 18' is preferably collapsed and folded into the general configuration as shown in FIG. 3 providing a pair of folded gusset panels 34 received inwardly of a pair of overlying flat panels 32. The blank 18' is then severed along the canted lines 64 shown in FIG. 5 providing triangular portions 66 adjacent opposite ends 68, 70 of the blank 18'. As in the previous embodiment, adjacent side edges of adjacent triangular portions 66 are connected together to form generally opposed side walls 16 of the liner 10.

Figure 6:
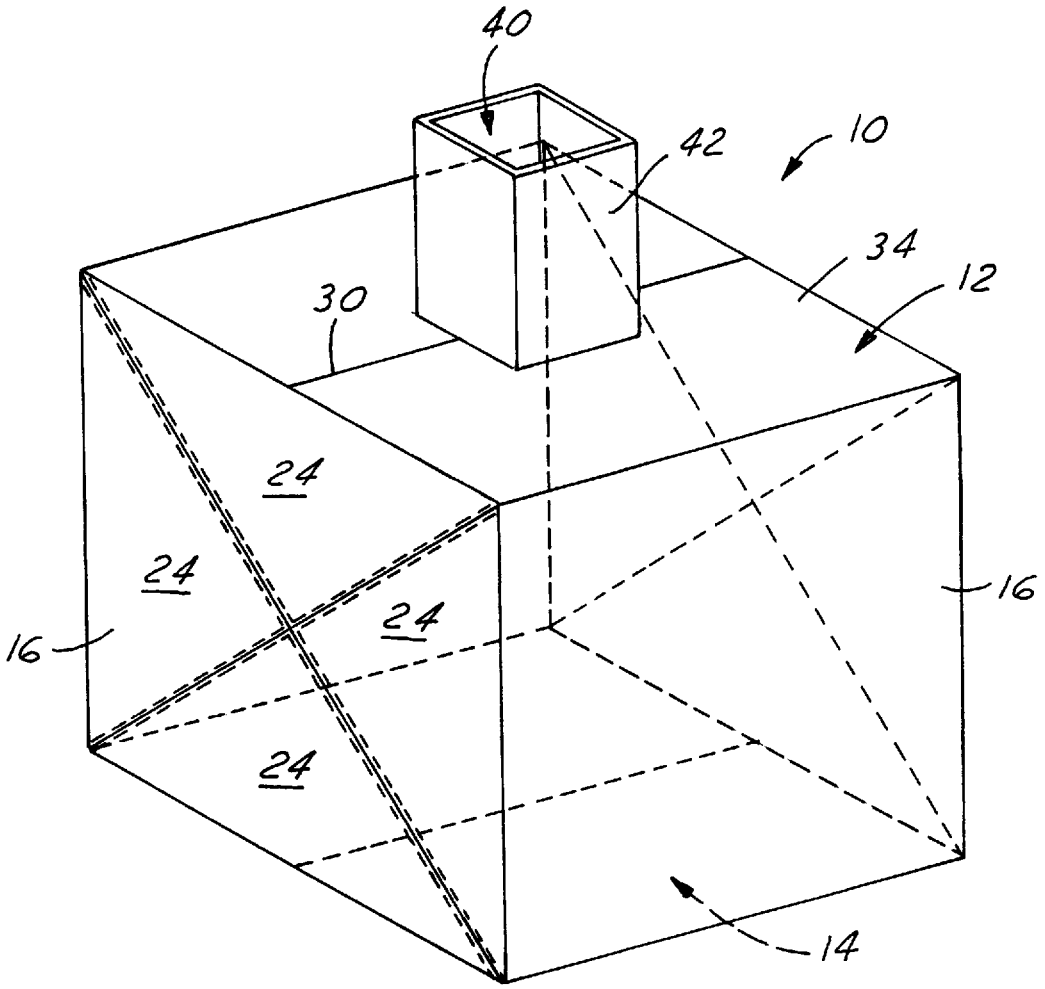
FIG. 6 is a perspective view of a liner embodying this invention and having an opening formed in a gusset panel.

Also as in the previous embodiment, an access opening 40 and an associated spout 42 are preferably provided in one or both of the top 12 and bottom 14 walls of the liner 10. To prevent the spout 42 from being disposed about a gusset panel 34 and hence, subject to being folded or crushed when the liner 10 is collapsed, the blank 18' is preferably configured such that the seam 62 of the tubular blank 18' is within a gusset panel 34 that is formed into a side wall 16 and the overlying flat panels 32 are formed into the top 12 and bottom 14 walls of the liner 10. Otherwise, if no spout 42 is desired or if it is acceptable to have the spout disposed on a gusset panel 34, as shown in FIG. 6 either the gusset panels 34 or the flat panels 32 can be formed into the top 12 and bottom 14 walls with the other panels having the seam 62 and forming a pair of generally opposed side walls 16.

When the liner 10 is filled, it assumes a generally rectangular or cubicle configuration with generally rectangular and seamless top 12 and bottom 14 walls and four interconnecting side walls 16 each of which is generally rectangular and two of which are formed by the triangular portions 24 or 66. The seams or lines of connection between triangular portions 24 are generally the weakest portion of the liner 10 and thus, the seamless top 12 and bottom 14 walls of the liner 10 are stronger, more durable and less likely to leak than the side walls 16 formed by the triangular portions 24. This is advantageous because when the liner 10 is filled with a liquid, high stresses result in the top 12 and bottom 14 of the liner 10 when the container 15 is lifted due to the shifting or splashing of the liquid during shipment and movement of the filled container 15.

I claim:

1. A collapsible liner for a bulk container which, when collapsed, comprises a flat blank of a flexible material and has a pair of flat overlying panels adapted to form a pair of generally opposed walls of the liner and a pair of folded gusset panels extending inwardly between the flat panels from the opposite side edges of the overlying panels and adapted to form two generally opposed walls of the liner, the blank having triangular portions adjacent each end of each flat panel and each end of each gusset panel, each triangular portion having a pair of sides extending toward an apex of the triangular portion with adjacent sides of adjacent triangular portions connected together forming a pair of generally opposed generally rectilinear side walls interconnected by seamless top and bottom walls and a second pair of opposed generally rectilinear seamless side walls, and an opening through one of the seamless walls for filling the liner.

2. The liner of claim 1 wherein the flat panels are adapted to form a pair of generally opposed end walls of the liner and the gusset panels are adapted to form a pair of generally opposed side walls of the liner.

3. The liner of claim 1 wherein the gusset panels are adapted to form a pair of generally opposed ends of the liner and the flat panels are adapted to form a pair of generally opposed side walls of the liner.

4. The liner of claim 1 wherein at least one of the flat panels or gusset panels has an opening therethrough for filling and emptying of the liner.

5. The liner of claim 4 wherein a spout is provided adjacent the opening.

6. The liner of claim 1 wherein the blank has a substantially circumferentially continuous central portion.

7. The liner of claim 6 wherein the blank is formed of one piece of material with opposing edges joined along a line of connection forming a generally tubular configuration.

8. The liner of claim 7 wherein the line of connection is disposed in a gusset panel and the gusset panel is adapted to form a side wall of the liner.

9. The liner of claim 7 wherein the line of connection is disposed in a flat panel and the flat panel is a sidewall of the liner.

10. The liner of claim 6 wherein the blank is formed from a seamless web of material.

11. A collapsible liner for a bulk container which comprises, a blank of flexible material which when collapsed has a pair of flat overlying panels adapted to form a pair of generally opposed walls of the liner and a pair of folded gusset panels extending inwardly between the flat panels from the opposite side edges of the overlying panels and adapted to form two generally opposed walls of the liner with at least one of the flat panels or gusset panels having an opening therethrough for filling of the liner, the blank having triangular portions adjacent each end of each flat panel and each end of each gusset panel, each triangular portion having a pair of sides extending toward an apex of the triangular portion with adjacent sides of adjacent triangular portions connected together forming a pair of generally opposed generally rectilinear side walls without any openings through them.

12. The liner of claim 11 which also comprises a spout at said one opening.

* * * * *